US007845304B2

(12) United States Patent
Daniels et al.

(10) Patent No.: US 7,845,304 B2
(45) Date of Patent: Dec. 7, 2010

(54) REMOVABLE BOAT WINDSHIELD

(75) Inventors: Brian K. Daniels, Bradenton, FL (US); Stuart A. Tyson, Bradenton, FL (US); Michael J Bryant, Bradenton, FL (US)

(73) Assignee: Taylor Made Group, LLC, Gloversville, NY (US)

( * ) Notice: Subject to any disclaimer, the term of this patent is extended or adjusted under 35 U.S.C. 154(b) by 3 days.

(21) Appl. No.: 12/248,515

(22) Filed: Oct. 9, 2008

(65) Prior Publication Data

US 2009/0101058 A1 Apr. 23, 2009

Related U.S. Application Data

(60) Provisional application No. 60/978,674, filed on Oct. 9, 2007.

(51) Int. Cl.
*B63B 17/00* (2006.01)

(52) U.S. Cl. ..... 114/361

(58) Field of Classification Search ..... 114/361
See application file for complete search history.

(56) References Cited

U.S. PATENT DOCUMENTS 3,829,153 A * 8/1974 Fussell, Jr. et al. ..... 296/90
3,894,305 A * 7/1975 Krenzler ..... 114/361
7,334,956 B2 * 2/2008 Taylor ..... 403/87

* cited by examiner

*Primary Examiner*—Stephen Avila
(74) *Attorney, Agent, or Firm*—Nixon & Vanderhye P.C.

(57) ABSTRACT

A removable boat windshield is provided that includes a transparent pane with a top end and a bottom end. At least one male portion is attached to the pane. At least one female portion is attachable to a deck of a boat. The at least one female portion defines a receiving opening for receiving at least a portion of the at least one male portion therein. The removable boat windshield also includes a securement device, operable with the at least one female portion, to releasably connect the male portion to the female portion.

19 Claims, 11 Drawing Sheets

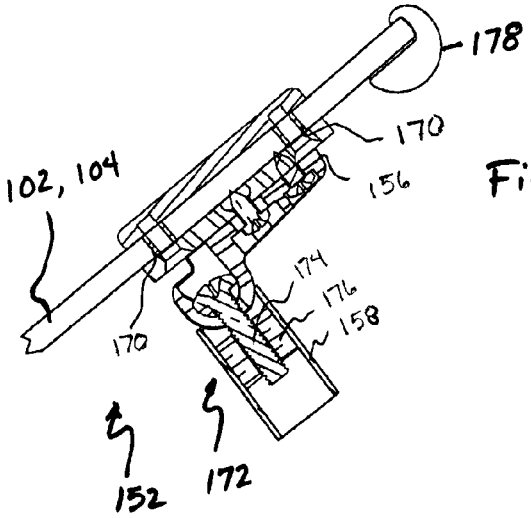
Fig. 19
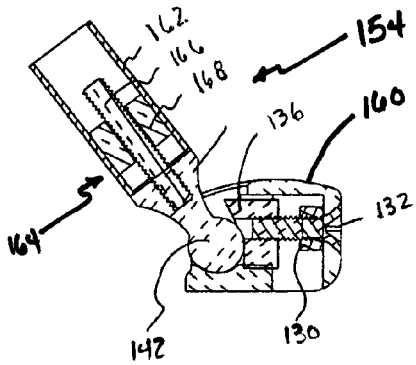
Fig. 18
Fig. 17
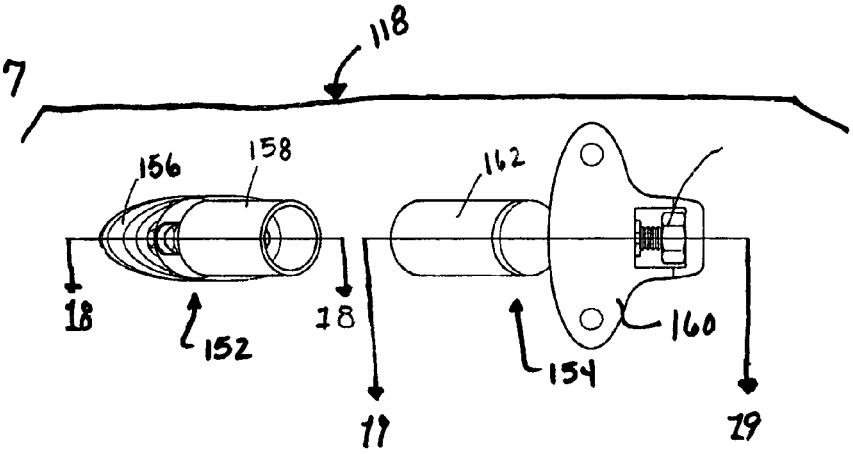

REMOVABLE BOAT WINDSHIELD

CROSS-REFERENCE TO RELATED APPLICATIONS

This application is a Non-Provisional U.S. patent application that relies for priority on U.S. Provisional Patent Application Ser. No. 60/978,674, filed on Oct. 9, 2007, the contents of which are incorporated herein by reference.

FIELD OF THE INVENTION

The invention relates to a windshield for a boat. In particular, the invention relates to a windshield for a boat where the windshield may be replaceably removed from the deck.

DESCRIPTION OF THE RELATED ART

In the boating industry, it is common for a windshield to be mounted on the deck of a boat (or other suitable type of watercraft) such that it cannot be removed easily, if at all, without damaging the deck of the boat.

As should be appreciated by those skilled in the art, it is common for boat owners to store boats seasonally, depending upon the extremes of weather experienced in a particular geographic region. Specifically, in more northern areas, it is quite common for boat owners to remove their boats from the water and have them stored in an appropriate marina storage facility during winter months.

In many cases, the windshields of boats are susceptible to damage during the process storing the boat in the appropriate marina facility. Accordingly, it is desirable to have a windshield that may be replaceably removed from the deck of the boat to reduce the occurrence of windshield damage.

Moreover, marina facilities often store boats in a stacked manner. Since the windshield adds to the overall height of a boat, a stack of taller boats requires a taller storage facility. Naturally, this adds to the cost of the storage facility and also adds to the individual cost of storage of the boat.

Naturally, to reduce storage costs, boat owners and marina facilities would like to store as many boats in as small a facility as is reasonable. One way to increase storage space is to reduce the height of the boat by, for example, removing the windshield.

Typically, the windshields are installed at the factory to make sure they fit properly. If they can be easily removed for shipping and reinstalled after delivery, it would reduce the cost of shipping. The stacking height is also a factor in reducing transportation cost. By removing the windshield more boats can be shipped on a single flat bed truck or train.

As should be appreciated by those skilled in the art, windshields on boats are typically affixed to the deck via threaded fasteners, adhesives, or a combination of the two. Accordingly, removal of the windshield is not a simple matter.

In addition, is a traditional windshield were removed and replaced in a repetitive manner, it is conceivable that the threaded holes in the deck could degrade after repeated removal and replacement of the windshield, thereby rendering the reattachment of the windshield to the deck a near impossibility (without, of course, drilling new holes in the deck).

Separate from the storage concerns, there is a growing portion of the boating community that would like to have the ability to remove a windshield from a boat before or during normal operation. For some boaters, a windshield is an inconvenience that they would like to eliminate, at their discretion.

Typically the windshield has a rim all the way round for protection. Some rimless windshields have been mounted to the deck in a metal channel. If the windshield is removed, the remaining channel is unsightly.

These needs in the prior art remains unaddressed.

SUMMARY OF THE INVENTION

It is, therefore, one aspect of the invention to provide a windshield that may be removably affixed to the deck of a boat.

In this regard, the invention provides for a removable boat windshield that includes a transparent pane with a top end and a bottom end. At least one male portion is attached to the pane. At least one female portion attachable to a deck of a boat. The at least one female portion defines a receiving opening for receiving at least a portion of the at least one male portion therein. A securement device releasably connects the male portion to the female portion. The securement device is associated with the at least one female portion.

The invention also provides for the at least one female portion to include a bracket block that defines the receiving opening.

With respect to one embodiment of the securement device, the invention provides a wedge disposed within a wedge channel in the at least one female portion. The wedge defines an inclined surface. An adjustment screw is rotatably connected to the wedge. Rotation of the adjustment screw moves the wedge within the wedge channel between a first position, where the inclined surface does not contact the at least one male portion, and a second position, where the inclined surface contacts the at least one male portion, thereby securing the at least one male portion to the at least one female portion.

The with respect to another embodiment of the securement device, the invention provides that the at least one female portion comprises a bracket block that define the receiving opening. The receiving opening is disposed in a longitudinal direction in the bracket block. The at least one female portion defines a hole extending through the bracket block transversely to the receiving opening. The securement device includes a pin that is removably disposable within the hole. When the pin is disposed within the hole, the pin prevents the at least one male portion from being removed from the receiving opening.

In still another embodiment of the invention, the at least one male portion includes a bracket securable to the pane and a protrusion attached to the bracket, extending a predetermined distance from the pane. At least a portion of the protrusion is received in the receiving opening of the at least one female portion.

With respect to one further embodiment of the invention, the at least one male portion includes a shaped end disposed at an end of the protrusion opposite to the bracket. The shaped end may be spherical.

Another embodiment of the invention provides for the bracket and protrusion of the at least one male portion to be integrally formed.

Other aspects of the invention will be made apparent to those skilled in the art from the description that follows and from the drawings appended hereto.

BRIEF DESCRIPTION OF THE DRAWINGS

The invention will now be described in connection with the drawings appended hereto, where like reference numerals refer to like structures, features, and elements, in which:

FIG. 17 is a plan view of a portion of a second embodiment of a vertical support member according to the invention;

FIG. 18 is a cross-sectional side view of a bottom portion of the vertical support member illustrated in FIG. 17, the cross-section being taken along the line 18-18; and FIG. 19 is a cross-sectional side view of a top portion of the vertical support member illustrated in FIG. 17, the cross-section being taken along the line 19-19.

DESCRIPTION OF EMBODIMENT(S) OF THE INVENTION

The invention will now be described in connection with one or more embodiments. It is intended that the embodiments be illustrative of the scope of the invention and not be limiting of the invention. In addition, as should be appreciated by those skilled in the art, there are numerous variations equivalents that also may be contemplated. Those variations and equivalents also are intended to be encompassed by the scope of the invention.

Figure 1:
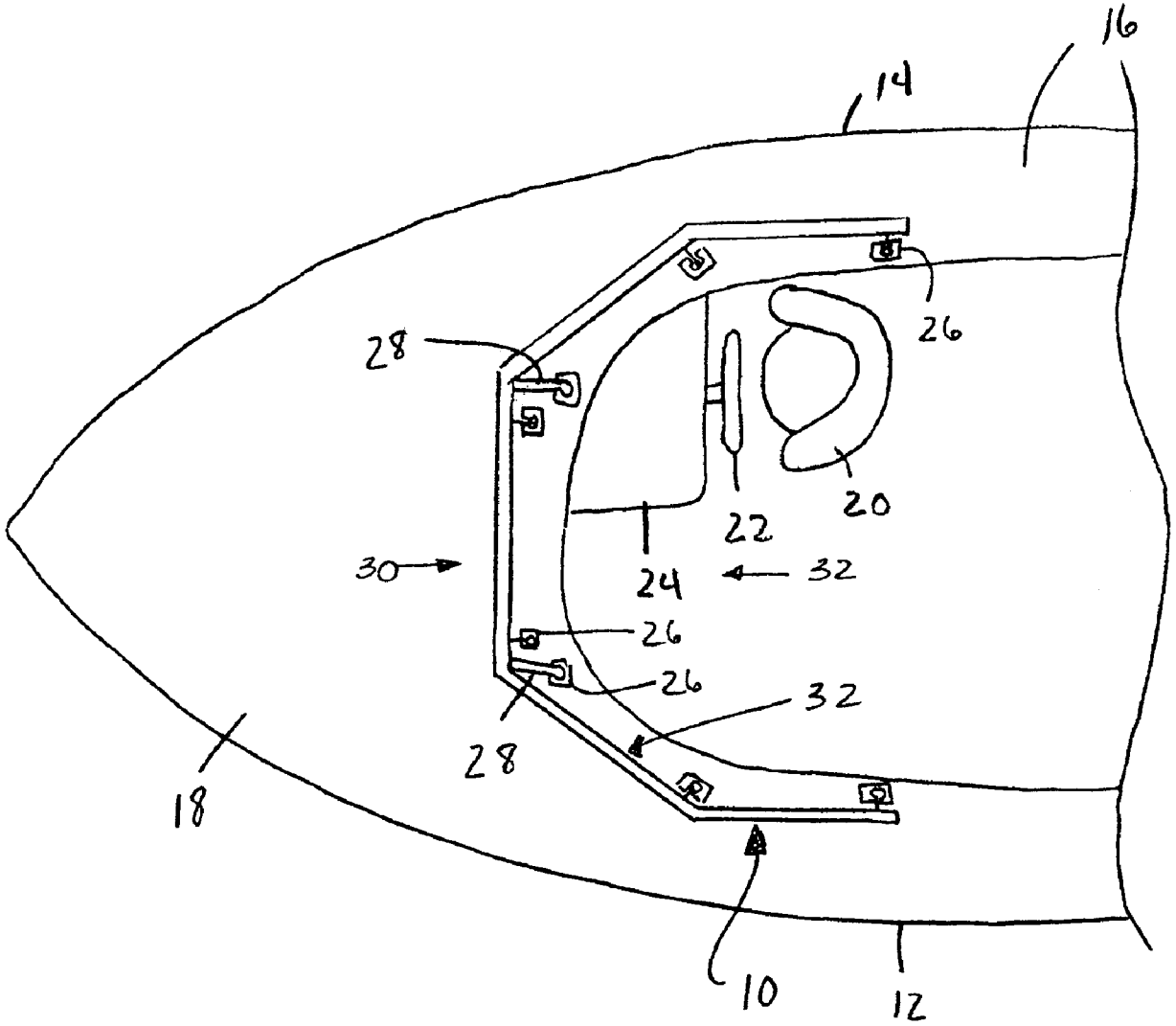
FIG. 1 partial, top plan view of a boat, showing a first embodiment of a removable windshield of the invention.

FIG. 1 provides a partial top plan view of the removable windshield 10 of the invention. The removable windshield 10 is illustrated as an angular member that extends from the port side 12 to the starboard side 14 of the deck 16. The bow portion 18 of the deck 16 is illustrated. For reference, FIG. 1 also includes a captain's chair 20, a steering wheel 22, and a steering console 24. These illustrated features are provided merely for reference. As would be appreciated by those skilled in the art, the deck may have any number of configurations that differ from the one illustrated.

By way of example, it is noted that the deck 16 of the boat may include a passenger area forward of the removable windshield 10. If the deck 16 includes such an area, it is common for the windshield to include a port and a starboard section, usually connected via an openable windshield section. The removable windshield 10 of the invention may be adapted to this configuration by separating the removable windshield 10 into port and starboard sections, as should be appreciated by those skilled in the art.

FIG. 1 also illustrates at least two additional features of the invention. First, FIG. 1 illustrates a plurality of securement portions 26, details of two embodiments of which are provided below. Second, FIG. 1 illustrates two vertical supports that may be provided to increase the vertical stability of the removable windshield 10 in certain configurations. For reference purposes, the front side 30 and the rear side 32 of the removable windshield 10 are indicated in FIG. 1. It is noted, however, that this is merely a convention to facilitate discussion of the invention.

Figure 2:
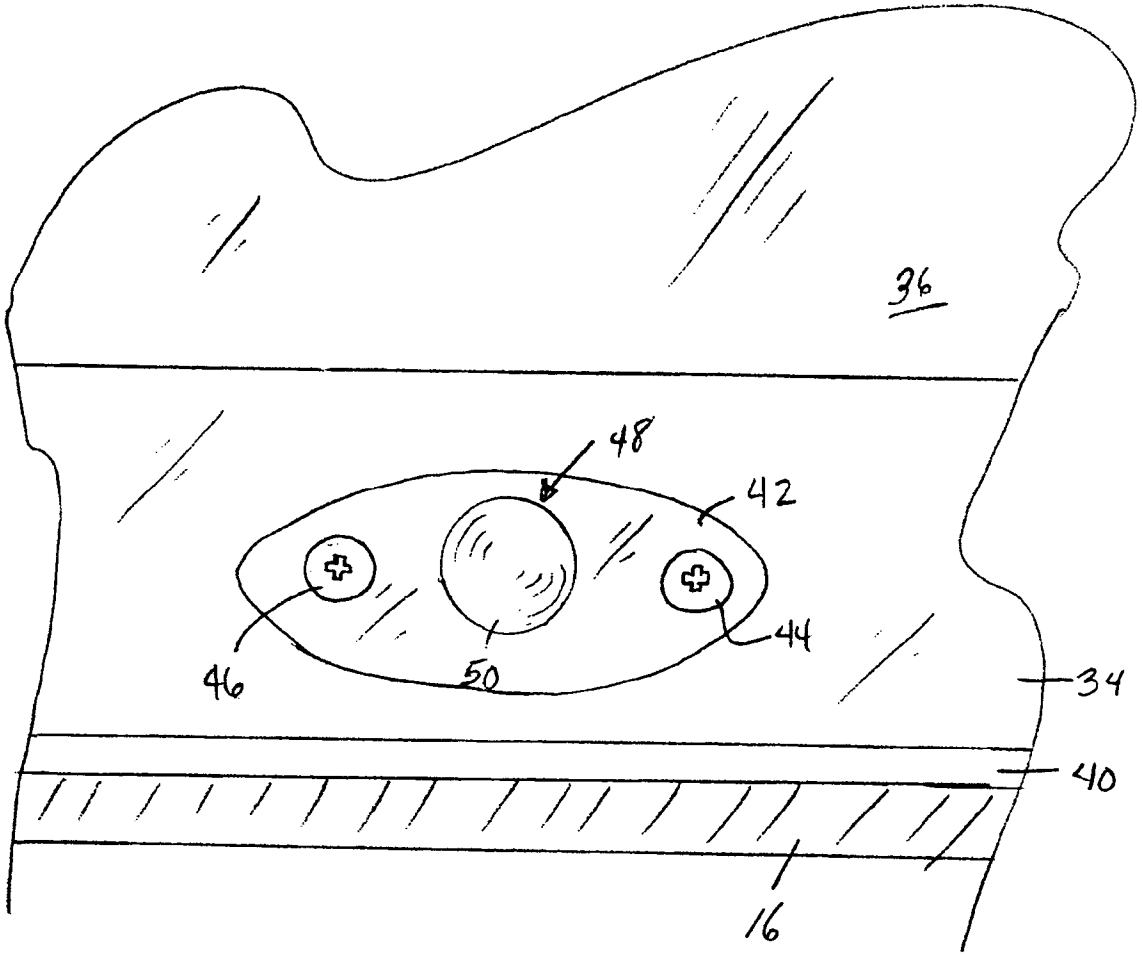
FIG. 2 is an enlarged rear view of a portion of the bottom rail of the first embodiment of the windshield of the invention shown in FIG. 1, illustrating one embodiment of the male securement portion of the invention.
Figure 8:
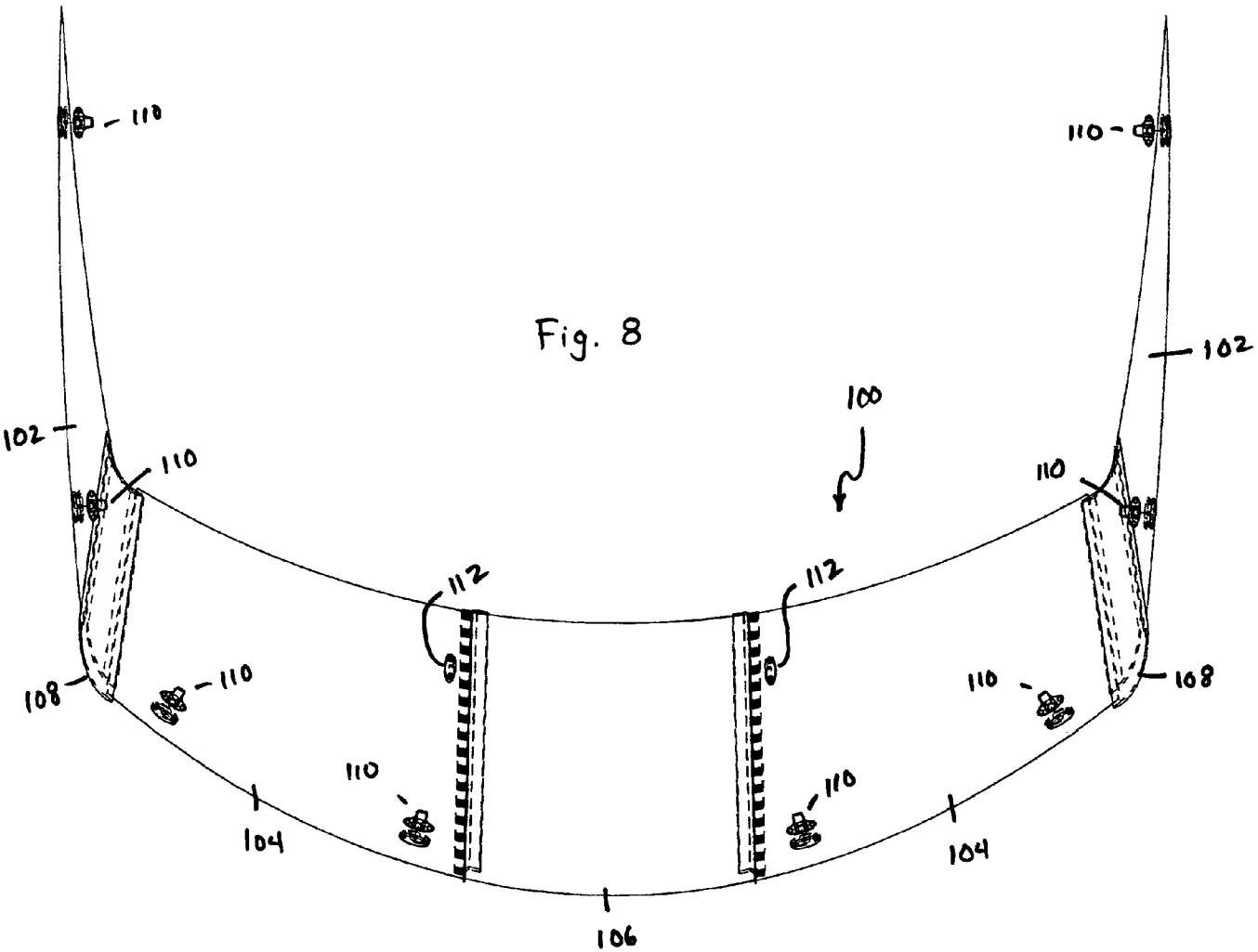
FIG. 8 is a top, plan view of a second embodiment of the removable windshield of the invention, shown separate and apart from the deck of a boat.
Figure 12:
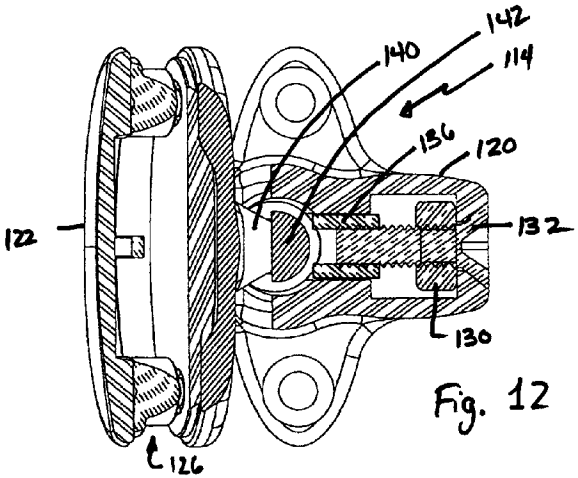
FIG. 12 is a cross-section of the securement portion illustrated in FIG. 11, the cross-section being taken along the line 11-11.
Figure 11:
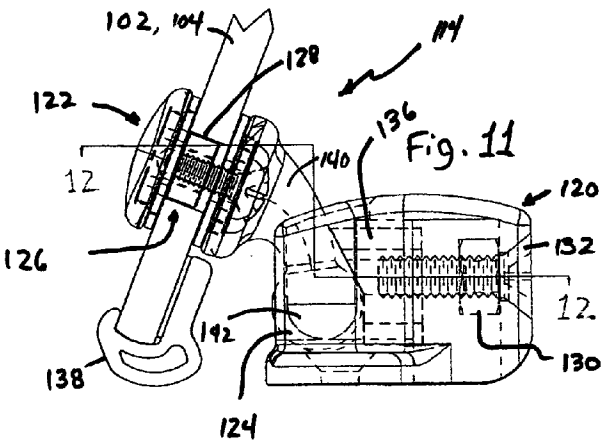
FIG. 11 is a side view of the securement portion illustrated in FIG. 9, showing some of the internal details thereof.
Figure 10:
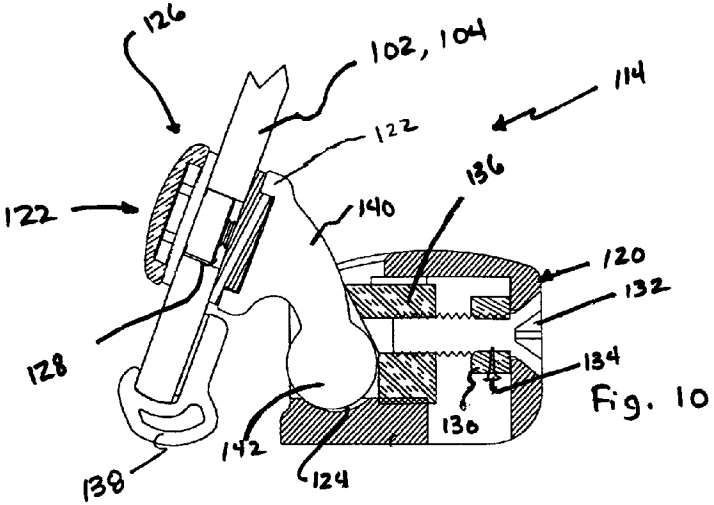
FIG. 10 is a cross-section of the securement portion illustrated in FIG. 9, the cross-section being taken along the line 10-10.

As should be appreciated by those skilled in the art, the typical boat windshield includes a bottom rail and a top rail that enclose one or more transparent panes. FIG. 2 provides a partial view of a bottom rail 34 that sits atop the deck 16. It is noted that either one (or both) of the top rail and the bottom rail may be omitted without departing from the scope of the invention, as illustrated in FIG. 8, which is discussed in greater detail below.

The view of the bottom rail 34 is from the rear side 32 of the removable windshield 10, as will be made more apparent in the discussion that follows. The bottom rail 34 may be made from any number of suitable materials including aluminum, steel, stainless steel, composites, plastics, etc. In at least one contemplated embodiment, the bottom rail 34 is made as an extruded aluminum component of the removable windshield 10. It is noted that aluminum provides excellent resistance to corrosion, which is desirable in marine environments.

A transparent pane 36 is affixed to the top end of the bottom rail 34. The transparent pane 36 may be made from any number of suitable materials including glass, acrylic, polycarbonate, or any other suitable transparent material. Typically, the transparent pane 36 is made from glass.

Figure 3:
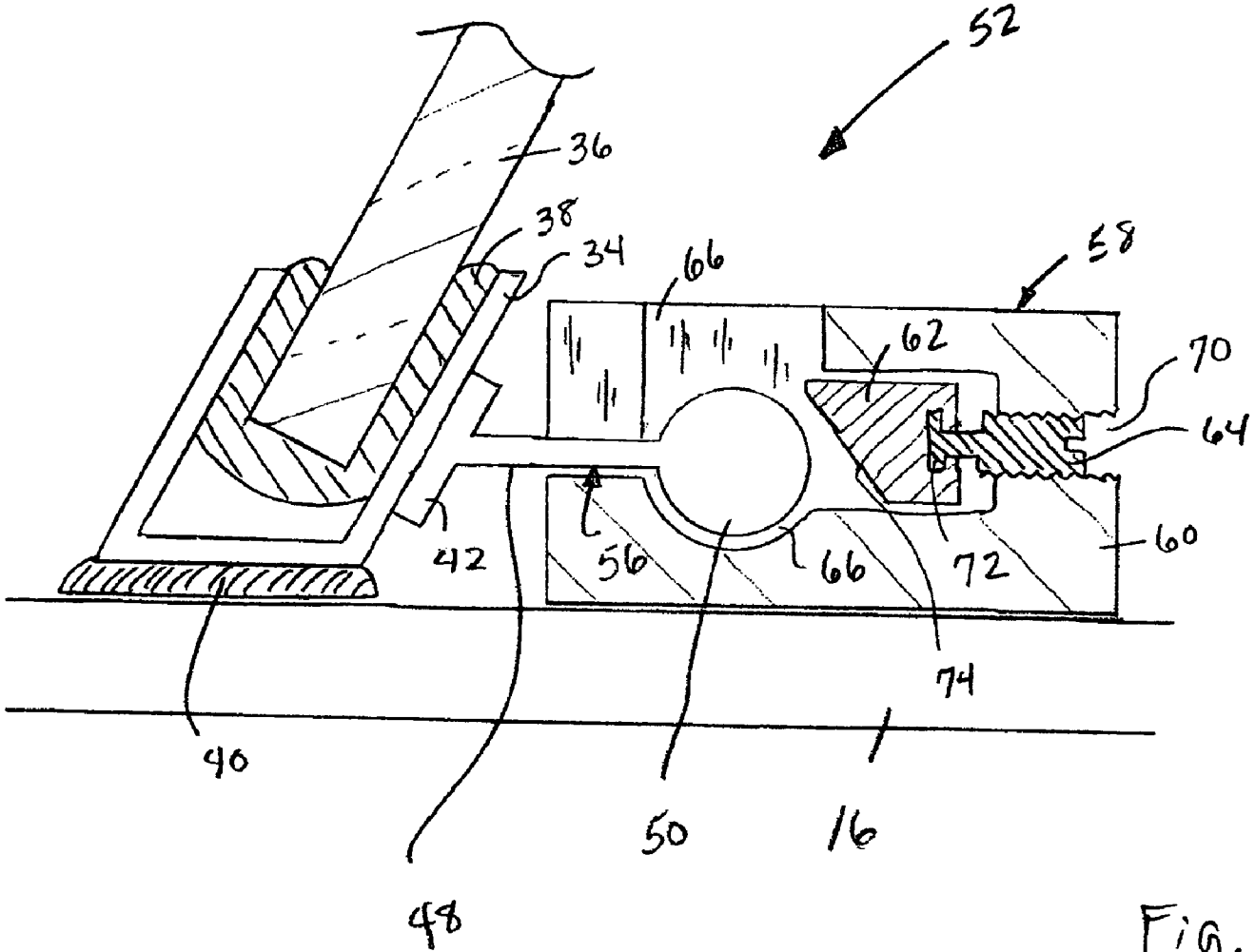
FIG. 3 is a cross-sectional, side view of a first embodiment of the securement portion of the invention.

With reference to FIG. 3, the bottom rail 34 includes an insert 38 to hold the transparent pane 36 in the bottom rail 34. The bottom rail also includes a seal 40 that provides a sealing engagement between the removable windshield 10 and the deck 16. The seal 40 may be made from any suitable material including neoprene, rubber, silicone rubber, or the like. In at least one contemplated embodiment of the invention, the seal 40 is made from a compressible material, such as rubber, to ensure a sufficient seal between the removable windshield 10 and the deck 16.

A bracket 42 is secured to the bottom rail 34. The bracket 42 may be made from any number of suitable materials including aluminum, steel, stainless steel, composites, plastics, etc. In the illustrated embodiment, at least because the bottom rail 34 is made from aluminum, the bracket 42 also is made from aluminum. In the illustrated embodiment, the bracket 42 is secured to the bottom rail via two screws 44, 46. As should be appreciated by those skilled in the art, the bracket 42 may be secured to the bottom rail 34 by any other suitable means, including adhesives, without departing from the scope of the invention.

As also illustrated, the bracket 42 includes a protrusion 48, which is a male portion of one of the securement potions 26. The protrusion 48 includes a spherical end 50, which will be described in greater detail below. As should be appreciated by those skilled in the art, while a spherical end 50 is employed by the various embodiments of the invention that are described herein, the end 50 need not be spherical. Instead, the end 50 may take any suitable shape depending upon the design of the securement portion 26.

With respect to the bracket 42, the protrusion 48, and the end 50, it is noted that these three elements, at least in the illustrated embodiment, are integrally formed. This means that the three structures are formed as a single unit. Of course, the three elements may be manufactured separately and connected to one another via welding or a suitable adhesive. In such a case, the assembled version of the bracket 42, the protrusion 48, and the end 50 also may be considered as "integral."

FIG. 3 illustrates a first embodiment of the securement portion 26 illustrated in FIG. 1 with respect to the removable windshield 10. In this embodiment, the securement portion is labeled 52 to distinguish it from the second embodiment of the securement portion 54 illustrated in FIGS. 5 and 6.

With reference to FIG. 3, the securement portion 52 includes two basic elements: a male portion 56 and a female portion 58. The male portion 56 includes the bracket 42, the protrusion 48, and the end 50. The female portion 56 includes a bracket block 60, a wedge 62, and an adjustment screw 64.

As illustrated in FIG. 3, the bracket block 60 includes a receiving opening 66 that is shaped to receive the protrusion 48 and the spherical end 50. At the end of the bracket block 60 opposite to the end with the receiving opening 66, the bracket block includes a wedge channel 68 in which the wedge 62 is slidably disposed. The wedge 62 is connected to the adjustable screw 64, which is accessible via an opening 70. In the illustrated embodiment, the adjustable screw 64 includes a T-shaped end 72 that is rotatably disposed within one end of the wedge 62. As is apparent, the opposite end of the wedge includes an inclined surface 74. The inclined surface 74 engages with the surface of the spherical end 50 of the male portion 56.

When the removable windshield 10 is installed on the deck, the male portions 56 are inserted into the complimentary receiving openings 66 in the associated bracket blocks 60. Once inserted into the bracket blocks 60, a user simply inserts a screwdriver into the end of the adjustable screw 64. As the adjustable screw 64 moves, it pushes the wedge 62 against the end 50. Once the wedge 62 contacts the end 50, the removable windshield 10 is secured against the deck 16. If the adjustable screw 64 is tightened further after the wedge contacts the end 50, the wedge 62 will apply a downward pressure on the end 50. This, in turn, will apply a compressive pressure to the seal 40 to ensure a sufficient seal between the bottom rail 34 and the deck 16.

Figure 4:
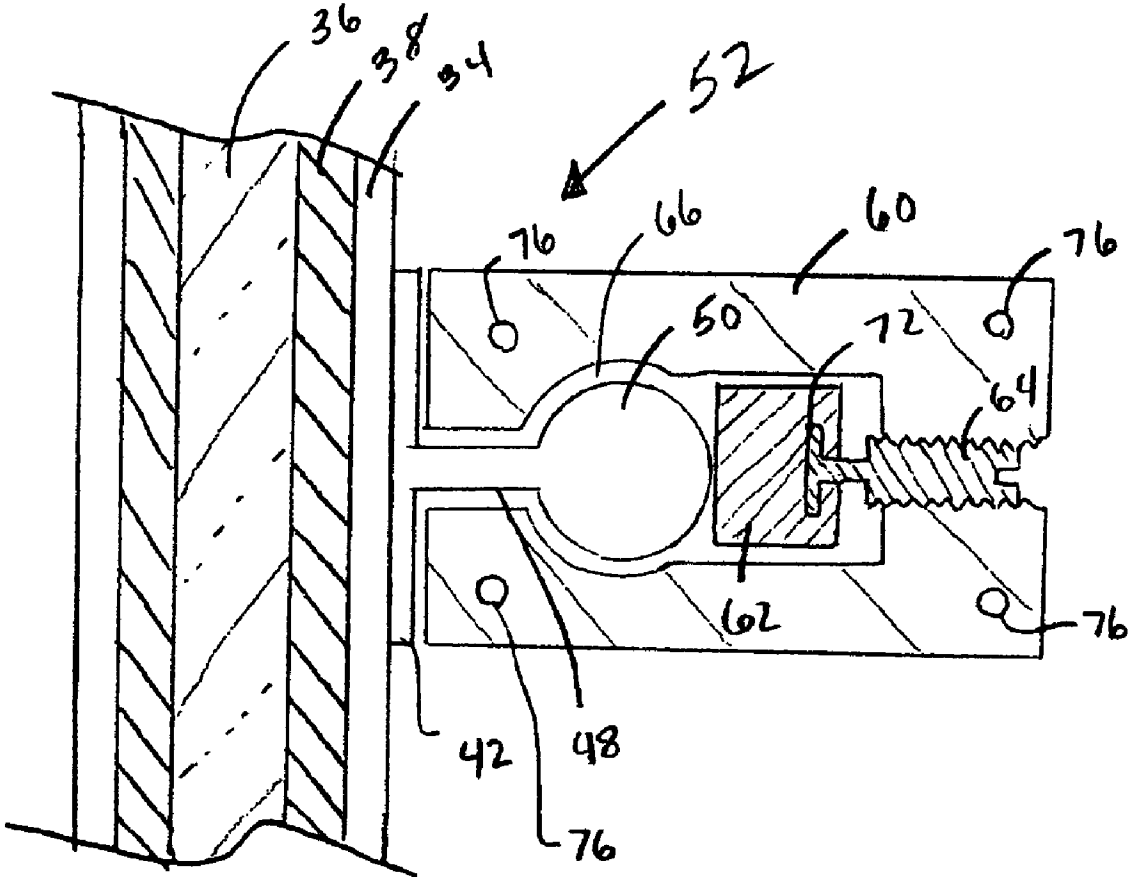
FIG. 4 is a cross-sectional top view of the embodiment of the securement portion of the invention illustrated in FIG. 3.

FIG. 4 provides a top view of the securement portion 52 that is illustrated in FIG. 3. FIG. 4 shows four screws 76 in cross-section that attach the bracket block 60 to the deck.

Figure 5:
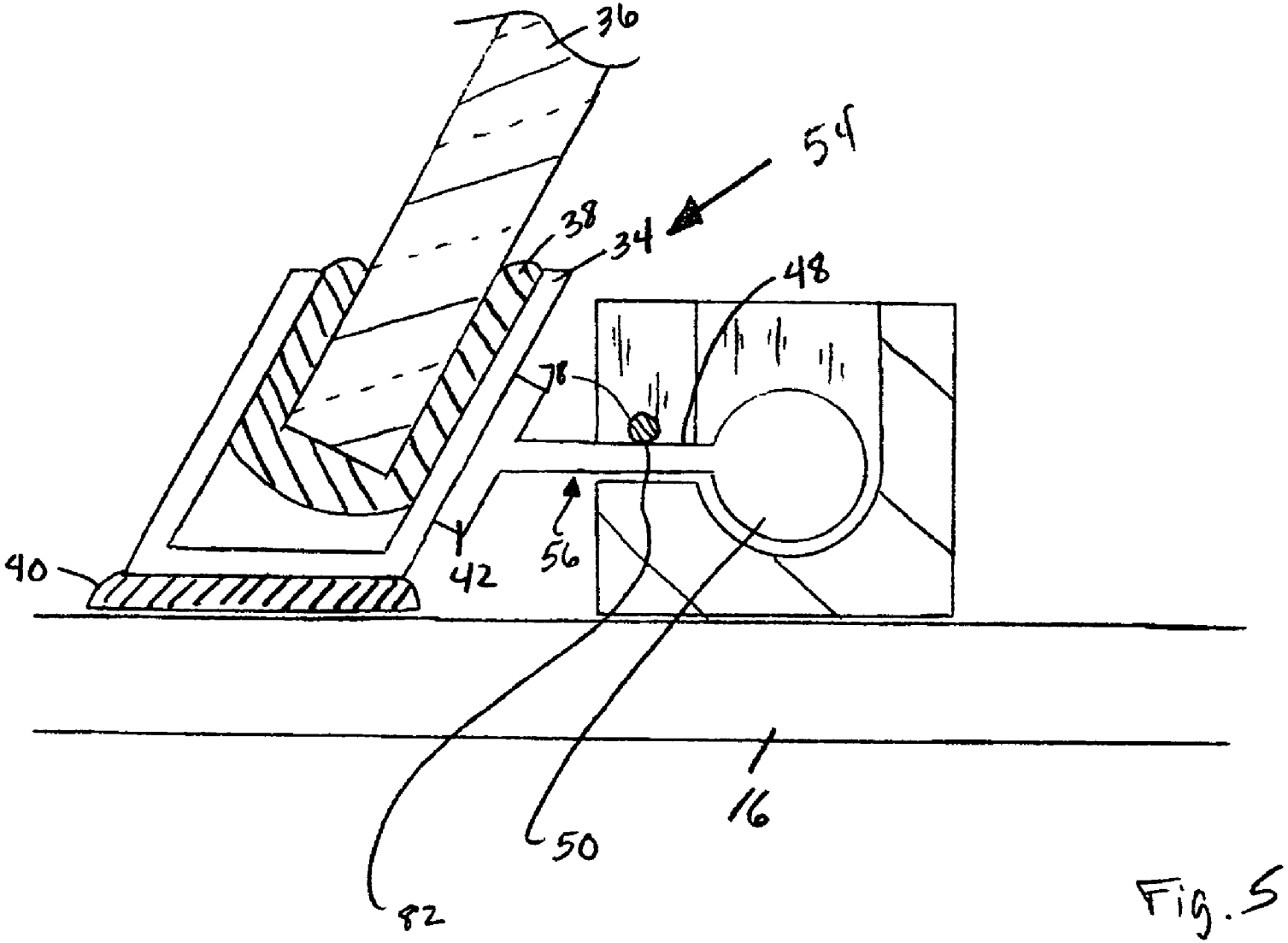
FIG. 5 is a cross-sectional side view of a second embodiment of the securement portion of the invention.
Figure 6:
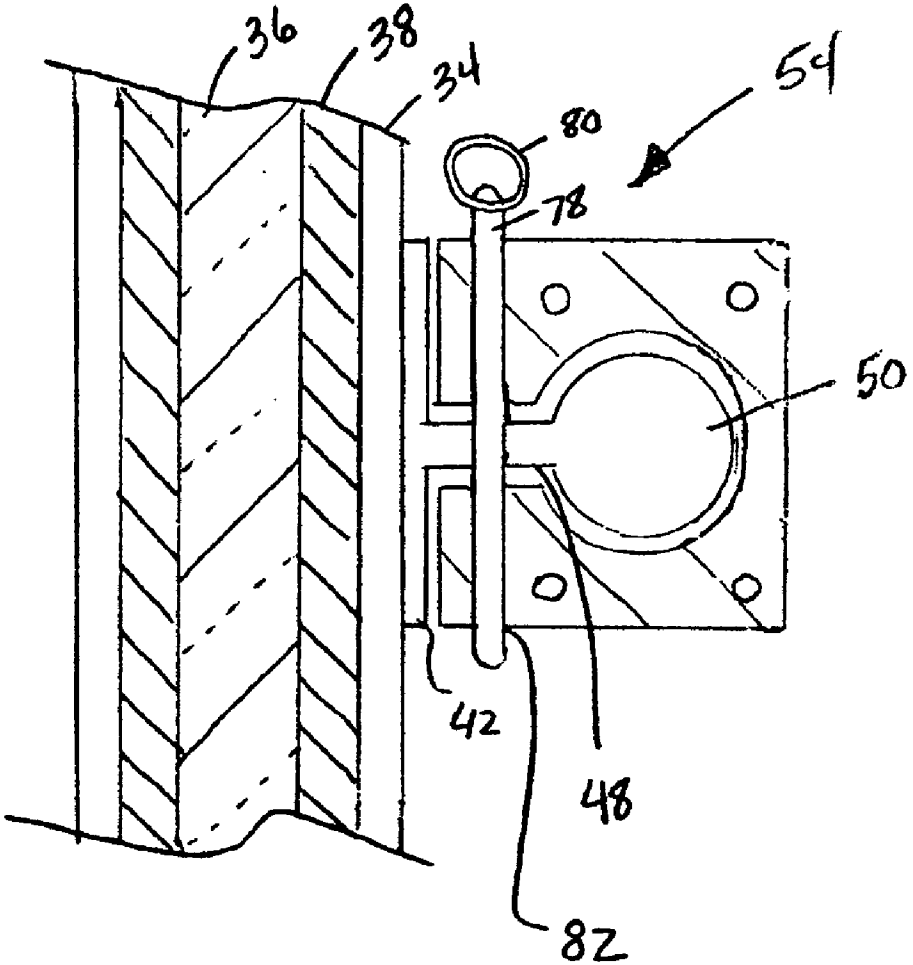
FIG. 6 is a cross-sectional top view of the second embodiment of the securement portion of the invention illustrated in FIG. 5.

FIGS. 5 and 6 illustrate a second embodiment of the securement portion 54. In this embodiment, a pin 78 with a ring 80 at one end is inserted into a hole 82 that extends across the protrusion 48. In this embodiment, the male portion 56 is inserted into the female portion 58.

During installation, pressure is applied to the removable windshield 10 so that the protrusion 48 sits below the hole 82. The pin 78 is then inserted into the hole 82 to retain the windshield 10 on the deck 16.

Figure 7:
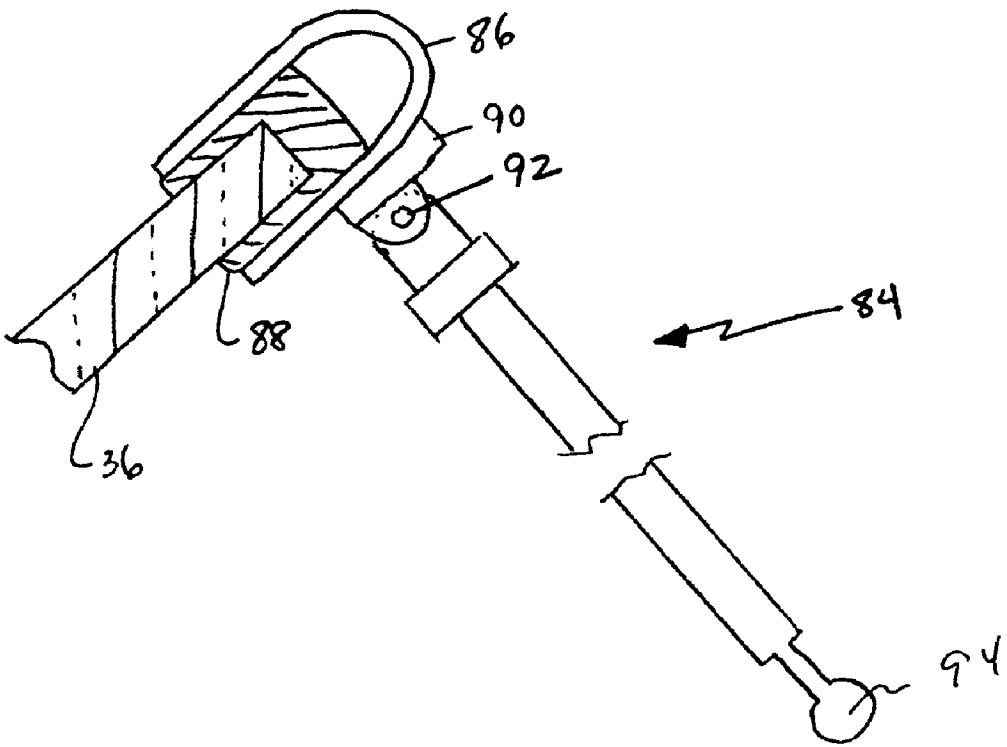
FIG. 7 is a partial cross-sectional side view of a first embodiment of a vertical support member of the invention.

FIG. 7 illustrates one further feature of the invention, a vertical bracket 84. The vertical bracket 84 connects between a top rail 86 and the deck 16. Specifically, the vertical bracket is designed to mate with one of the bracket blocks 60. As illustrated, the transparent pane 36 is positioned within an insert 88. The top rail 86 is affixed to a bracket 90 on which a pivot 92 is positioned. The top end of the vertical bracket 84 pivotally connects to the pivot 92. The bottom end of the vertical bracket 84 includes a spherical end 94 that is insertable into the female portion of one of the securement portions 52, 54.

Reference is now made to FIG. 8, which illustrates a second embodiment of the windshield 100. As with the windshield 10 comprises one or more transparent panes 102, 104, 106 that may be connected to one another via corner connectors 108. In this embodiment, the windshield 100 is constructed to omit both the bottom and top rails. Of course, as noted above, one or both of the bottom or top rails may be provided without departing from the scope of the invention. As also illustrated, and consistent with the prior embodiment, several securement portions 110 are provided to secure the windshield 100 to the deck of a boat (not illustrated in FIG. 8). Vertical supports (not illustrated in FIG. 8) also may be provided. These vertical supports connect at vertical support brackets 112, as illustrated.

Third and fourth embodiments of the securement portions 110 are illustrated in FIGS. 9-16. The third embodiment of the securement portions are labeled 114 and the fourth embodiment of the securement portions are labeled 116. FIGS. 17-19 illustrate another contemplated embodiment of a vertical support portion 118.

The securement portions 114, 116 are intended to attach directly to the transparent panes 102, 104, as noted above. This feature is particularly apparent in FIGS. 10 11, 14, and 15.

Figure 9:
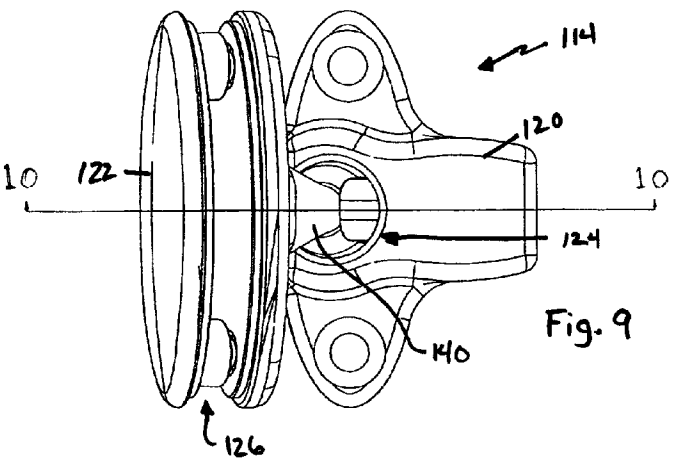
FIG. 9 is a plan view of a third embodiment of a securement portion that may be used with the removable windshield illustrated in FIGS. 1 and 8.
Figure 14:
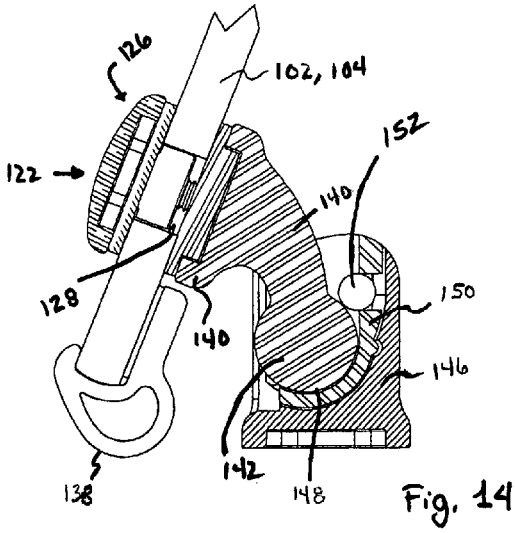
FIG. 14 is a cross-section of the securement portion illustrated in FIG. 13, the cross-section being taken along the line 14-14.
Figure 16:
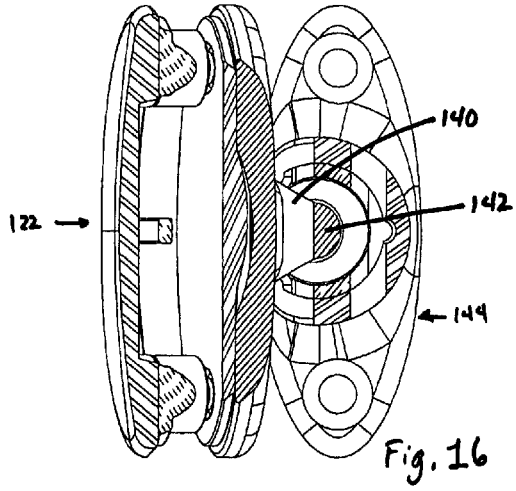
FIG. 16 is a cross-section of the securement portion illustrated in FIG. 15, the cross-section being taken along the line 16-16.
Figure 13:
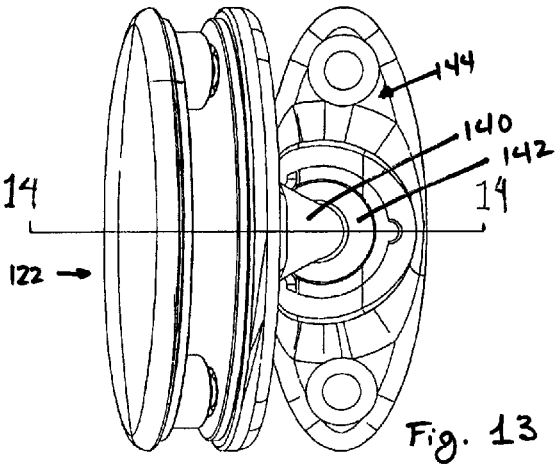
FIG. 13 is a plan view of a fourth embodiment of a securement portion that may be used with the removable windshield illustrated in FIGS. 1 and 8.
Figure 15:
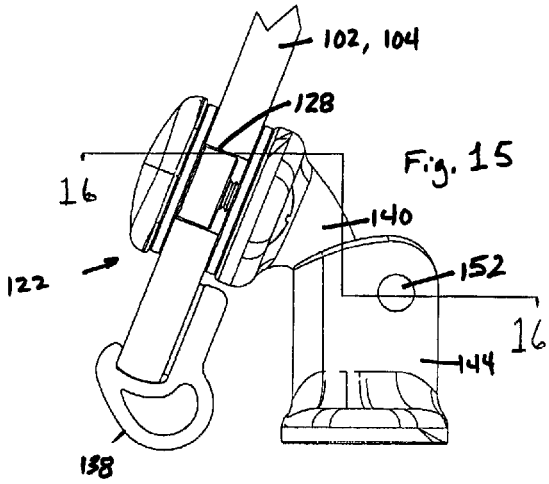
FIG. 15 is a side view of the securement portion illustrated in FIG. 13.

With reference to FIG. 9, the securement portion 114 includes a female portion 120 (or female bracket) and a male portion 122 (or male bracket). The male portion 122 is inserted into an opening in the female portion 120.

The windshield 100 is connected to the securement portion 114 via a screw assembly 126 through one or more holes 128 in the windshield 100. For the embodiments illustrated in FIGS. 9-16, two holes 128 are provided for each securement portion 114, 116.

With reference to the female portion 120, a locking element is disposed therein, as in prior described embodiments. In this embodiment, a nut or other limiting device 130 is secured to a screw 132, which may or may not be set by a set screw 134. As should be appreciated by those skilled in the art, the limiting device 130 limits the axial movement of the screw 132 to produce axial movement of a wedge 136 relative to the screw 132 when the screw 132 is rotated.

In this embodiment, since the bottom rail is omitted, a seal 138 is mounted directly to the transparent pane 102, 104. Thus the windshield 100 is truly a rimless windshield with no bottom rail or deck mounted track.

As also illustrated in FIGS. 9-12, the male portion 122 of the securement portion 114 includes a protrusion 140 and a spherical end 142. The protrusion 140 and spherical end 142 cooperate with the female portion 120 to secure the windshield 100 to the deck of a boat, as should be appreciated by those skilled in the art.

The securement portion 116 presents a modification of the securement device 114. Specifically, as illustrated in FIGS. 13-16, the male portion 122 is the similar to or may be the same as the male portion 122 illustrated in FIGS. 9-12. It is noted that the seal 138 presents a different shape in this embodiment. However, the seal 138 may take any suitable shape, as should be appreciated by those skilled in the art.

Returning to FIGS. 9-12, the female portion 144 differs from the female portion 120 discussed in connection with the previous embodiment. In this embodiment, the female portion 144 includes a bracket 146 that defines an opening 148 lined with a liner (or insert) 150. The liner or insert 150 may be made from any suitable material (including polytetrafluoroethylene, plastic, rubber, or suitable elastomer) to facilitate a connection between the male portion 122 and the female portion 144. Specifically, the liner 150 is expected to reduce noise that might be generated between the male portion 122 and the female portion 144.

A locking device 152 is also provided to secure the male portion 122 to the female portion 144. The locking device 152 may operate in a similar fashion to the pin 78, discussed above.

FIGS. 17-19 illustrate a second embodiment of a vertical support portion 118. Here, the vertical support portion 118 includes a top portion 152 and a bottom portion 154. The top portion 152 illustrated in FIG. 19, and the bottom potion 154 is illustrated in FIG. 18. The top portion 152 connects with the transparent pane 102, 104. The bottom portion 154 connects to the deck of a boat (not illustrated). As shown generally in FIG. 17, the top portion 152 includes a bracket 156 and a tubular member (or sleeve) 158 connected to the bracket 156. The bottom portion 154 also includes a bracket 160 and a tubular member (or sleeve) 162 connected to the bracket 160.

It is noted that the tubular members (or sleeves) 158, 160 may accept a tubular pipe between them (not illustrated). Alternatively, the tubular members 158, 160 may themselves represent portions of a tubular pipe that extends between the brackets 156, 160. Other variations also should be apparent to those skilled in the art.

With reference to FIG. 18, the bracket 160 may be designed similarly to the female portion 120 discussed above. If so, the bracket 160 includes a screw 132, limiting device 130 and wedge 136, as discussed above.

The tubular member 162 includes an end 142 that permits a connection between the tubular member 162 and the bracket 160. The tubular member 162 also may include an adjustment device 164 to permit adjustment between the end 142 and the tubular member 162. In the illustrated example, the adjustment device 164 includes a screw 166 and a nut or limiting device 168.

With reference to FIG. 19, the bracket 156 of the top portion 152 connects to the transparent pane 102, 104 via one or more screws 170. The tubular member 158 also may include an adjustment device 172. As with the adjustment device 172 may include a screw 174 and a limiting device or nut 176.

As also illustrated in FIG. 19, the top edge of the transparent pane 102, 104 may be finished with a suitable embellishment 178.

As should be apparent, the screws 166, 174 permit telescopic adjustment between the brackets 156, 160 and the tubular members 158, 162.

As should be understood by those skilled in the art, the vertical support portion 118 may or may not be required to practice the invention. Specifically, one or more of the vertical support portions 118 may be employed if the windshield 100 includes two or more sections.

The embodiments discussed herein are meant to be illustrative of the broad scope of the invention. They are not meant to be limiting of the invention solely to the embodiments described or illustrated. To the contrary, as should be appreciated by those skilled in the art, there are variations and equivalents of the invention that may be employed. The invention is intended to encompass those variations and embodiments.

What is claimed is:

1. A removable boat windshield, comprising:

a transparent pane with a top end and a bottom end;

at least one male portion attached to the pane;

at least one female portion attachable to a deck of a boat, defining a receiving opening for receiving at least a portion of the at least one male portion therein; and a securement device, operable with the at least one female portion, to releasably connect the male portion to the female portion, wherein the securement device comprises:

a wedge disposed within a wedge channel in the at least one female portion, the wedge defining an inclined surface, and an adjustment screw rotatably connected to the wedge, wherein rotation of the adjustment screw moves the wedge within the wedge channel between a first position, where the inclined surface does not contact the at least one male portion, and a second position, where the inclined surface contacts the at least one male portion, thereby securing the at least one male portion to the at least one female portion.

2. The removable boat windshield of claim 1, wherein the at least one female portion includes a bracket block that defines the receiving opening.

3. A removable boat windshield comprising:

a transparent pane with a top end and a bottom end;

at least one male portion attached to the pane;

at least one female portion attachable to a deck of a boat, defining a receiving opening for receiving at least a portion of the at least one male portion therein; and a securement device, operable with the at least one female portion, to releasably connect the male portion to the female portion, wherein the at least one female portion comprises a bracket block that defines the receiving opening, the receiving opening is disposed in a longitudinal direction in the bracket block, and the at least one female portion defines a hole extending through the bracket block transversely to the receiving opening, the securement device comprising a pin removably disposable within the hole and positionable to obstruct a portion of the receiving opening without extending through the at least one male portion, wherein, when the pin is disposed within the hole, the pin prevents the at least one male portion from being removed from the receiving opening.

4. The removable boat windshield of claim 1, wherein the at least one male portion comprises:

a bracket securable to the pane; and a protrusion attached to the bracket, extending a predetermined distance from the pane;

wherein at least a portion of the protrusion is received in the receiving opening of the at least one female portion.

5. The removable windshield of claim 4, wherein the at least one male portion further comprises:

a shaped end disposed at an end of the protrusion opposite to the bracket.

6. The removable windshield of claim 5, wherein the shaped end is spherical.

7. The removable windshield of claim 4, wherein the bracket is securable to the pane via threaded fasteners.

8. The removable windshield of claim 4, wherein the bracket and the protrusion are integrally formed.

9. The removable windshield of claim 6, wherein the bracket, the protrusion, and the shaped end are integrally formed.

10. The removable windshield of claim 1, wherein the at least one female portion is attachable to the deck of the boat via threaded fasteners.

11. The removable windshield of claim 1, further comprising:

a bottom rail attached to a bottom end of the pane, wherein the at least one male portion is attached to the bottom rail.

12. The removable windshield of claim 1, wherein the at least one male portion is attached to the pane by fasteners through holes in the pane.

13. The removable windshield of claim 3, wherein the at least one male portion comprises:

a bracket securable to the pane; and a protrusion attached to the bracket, extending a predetermined distance from the pane;

wherein at least a portion of the protrusion is received in the receiving opening of the at least one female portion.

14. The removable windshield of claim 13, wherein the at least one male portion further comprises:

a shaped end disposed at an end of the protrusion opposite to the bracket.

15. The removable windshield of claim 14, wherein the shaped end is spherical.

16. The removable windshield of claim 13, wherein the bracket is securable to the pane via threaded fasteners.

17. The removable windshield of claim 3, wherein the at least one female portion is attachable to the deck of the boat via threaded fasteners.

18. The removable windshield of claim 3, further comprising:

a bottom rail attached to a bottom end of the pane, wherein the at least one male portion is attached to the bottom rail.

19. The removable windshield of claim 3, wherein the at least one male portion is attached to the pane by fasteners through holes in the pane.

* * * * *